US011713875B2

(12) United States Patent
Beck et al.

(10) Patent No.: US 11,713,875 B2
(45) Date of Patent: Aug. 1, 2023

(54) CLADDING INCLUDING INTEGRATED LIGHT SOURCE

(71) Applicant: CertainTeed LLC, Malvern, PA (US)

(72) Inventors: David H. Beck, Jackson, MI (US); Robert T. Clark, Philadelphia, PA (US); David J. Stucky, Grass Lake, MI (US); Mark G. Suchyna, Lancaster, NY (US); Conor McDonald, Cleveland, OH (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 17/963,554

(22) Filed: Oct. 11, 2022

(65) Prior Publication Data

US 2023/0033384 A1 Feb. 2, 2023

Related U.S. Application Data

(63) Continuation of application No. 17/136,627, filed on Dec. 29, 2020, now Pat. No. 11,466,850.

(60) Provisional application No. 62/955,036, filed on Dec. 30, 2019.

(51) Int. Cl.

| | |
|---|---|
| ***F21V 33/00*** | (2006.01) |
| ***E04F 13/08*** | (2006.01) |
| ***F21V 23/00*** | (2015.01) |
| ***F21Y 115/10*** | (2016.01) |
| ***E04F 13/18*** | (2006.01) |

(52) U.S. Cl.

CPC ..... *F21V 33/006* (2013.01); *E04F 13/0889* (2013.01); *F21V 23/003* (2013.01); *E04F 13/18* (2013.01); *F21Y 2115/10* (2016.08)

(58) Field of Classification Search

CPC ... E04F 13/0862; E04F 13/0889; E04F 13/18; F21S 4/28; F21V 23/003; F21V 33/006

See application file for complete search history.

(56) References Cited

U.S. PATENT DOCUMENTS

| | | | |
|---|---|---|---|
| 6,991,350 | B2 | 1/2006 | McInnis |
| 8,080,819 | B2 | 12/2011 | Mueller |
| 8,109,659 | B2 | 2/2012 | Doubek |
| 8,516,765 | B2 | 8/2013 | Shaw |

(Continued)

FOREIGN PATENT DOCUMENTS

| | | | |
|---|---|---|---|
| CA | 2592879 | A | 11/2008 |
| CN | 105864715 | A | 8/2016 |

(Continued)

*Primary Examiner* — Britt D Hanley

(74) *Attorney, Agent, or Firm* — McDonnell Boehnen Hulbert & Berghoff LLP

(57) ABSTRACT

The present disclosure relates generally to cladding, for example, suitable for use covering the exterior surface of a building. The present disclosure relates more particularly to a siding panel including a light source. The siding panel includes a panel body having a length extending from a first end to a second end, a width extending from a first edge to a second edge, a front face, and a rear face. A first lock extends along the first edge of the panel body and a second lock extending along the second edge of the panel body. A fastening strip is coupled to the first lock. A light source extending along the length of the panel body is secured to the panel body so as to provide light from the front face of the panel body.

20 Claims, 7 Drawing Sheets

(56) References Cited

U.S. PATENT DOCUMENTS

| | | | |
|---|---|---|---|
| 9,316,369 | B2 | 4/2016 | Sarrant-Foresti |
| 9,374,856 | B2 | 6/2016 | Winton |
| 9,377,183 | B2 | 6/2016 | Holman |
| 9,502,620 | B2 | 11/2016 | Cumpston |
| 9,605,432 | B1 | 3/2017 | Robbins |
| 10,378,705 | B2 | 8/2019 | Meir |
| 10,787,818 | B2 | 9/2020 | Schultz |
| 10,920,429 | B2 | 2/2021 | Shaw |
| 11,072,930 | B2 | 7/2021 | Colyn |
| 2009/0251917 | A1 | 10/2009 | Wollner |
| 2011/0225916 | A1 | 9/2011 | Lindal |
| 2014/0133137 | A1 | 5/2014 | Kiss |
| 2018/0252860 | A1 | 9/2018 | Zheng |
| 2018/0292080 | A1 | 10/2018 | Haider |
| 2021/0222865 | A1 | 7/2021 | Beck |

FOREIGN PATENT DOCUMENTS

| | | | | | |
|---|---|---|---|---|---|
| CN | 106894602 | A | | 6/2017 | |
| CN | 108868037 | A | | 11/2018 | |
| CN | 111173215 | A | | 5/2020 | |
| CN | 111691628 | A | | 9/2020 | |
| DE | 202013000647 | U1 | | 1/2014 | |
| EP | 1783423 | A1 | | 5/2007 | |
| EP | 2639495 | B1 | | 11/2016 | |
| JP | 2005-194723 | A | | 7/2005 | |
| JP | 2015-140644 | A | | 8/2015 | |
| KR | 20110042732 | A | * | 4/2011 | ..... E04F 13/0846 |
| KR | 20110042732 | A | | 4/2011 | |
| KR | 20170019685 | A | | 2/2017 | |
| KR | 20200119557 | A | | 10/2020 | |
| NL | 1028080 | C2 | | 7/2006 | |
| WO | 2017051100 | A1 | | 3/2017 | |
| WO | 2018012077 | A1 | | 1/2018 | |
| WO | 2018130429 | A1 | | 7/2018 | |

* cited by examiner

CLADDING INCLUDING INTEGRATED LIGHT SOURCE

CROSS-REFERENCE TO RELATED APPLICATIONS

This application claims is a continuation of U.S. patent application Ser. No. 17/136,627, which claims the benefit of priority of U.S. Provisional Patent Application No. 62/955,036, filed Dec. 30, 2019, each of which is hereby incorporated herein by reference in its entirety.

BACKGROUND OF THE DISCLOSURE

1. Field of the Disclosure

The present disclosure relates generally to cladding, for example, suitable for covering a building surface. The present disclosure relates more particularly to siding panels including an integrated light source.

2. Technical Background

Exterior lighting is popular in both residential and commercial applications. Lighting around a building structure provides both added safety to those inside and outside the structure and is considered aesthetically desirable. There are various types of external lighting that illuminate building exteriors. Ground lighting that is positioned around the building structure may be oriented to shine light on the building exterior. Likewise, lighting installed on the structure itself, such as in the eaves of a house, or under a porch roof, providing light on the building exterior. Further, decorative lights, such as string lights or "Christmas" lights, are often placed on building exteriors to provide lighting that follows the architecture of the building structure.

A downside of such exterior lighting is that the lighting requires significant time and/or expense to install. For example, ground lighting requires exterior installation and wiring, all of which must be protected from the elements. Similarly, lighting installed directly on the building structure requires modification of the exterior surfaces to provide both mounting locations and wiring. For example, lights under the eaves of a house are typically installed by cutting a hole through the soffit, installing a lighting housing, and providing wiring within the structure. String lights, on the other hand, typically have a temporary installation, where the lights are hung seasonally and then removed after a few weeks or months.

The present inventors have recognized that a system for providing lighting on the exterior surface of a building without costly or time consuming installation would be desirable to both home buyers and builders.

SUMMARY OF THE DISCLOSURE

In one aspect, the present disclosure provides a siding panel including a light source, the siding panel comprising:

- a panel body having a length extending from a first end to a second end, a width extending from a first edge to a second edge, a front face, and a rear face;
- a first lock extending along the first edge of the panel body;
- a second lock extending along the second edge of the panel body;
- a fastening strip coupled to the first lock; and

- a light source extending along the length of the panel body and secured to the panel body so as to provide light from the front face of the panel body.

In another aspect, the disclosure provides a siding panel configured to receive a light source, the siding panel comprising:

- a panel body including:
  - a length extending from a first end to a second end,
  - a width extending from a first edge to a second edge,
  - a front face,
  - a rear face,
  - a first vertically-extending section having a top edge and a bottom edge,
  - a first overhang that extends rearward from the bottom edge of the first vertically-extending section, the first overhang including a receiving channel disposed behind the first vertically-extending section that is configured to receive a light source;
- a first lock extending along the first edge of the panel body;
- a second lock extending along the second edge of the panel body; and
- a fastening strip coupled to the first lock.

In another aspect, the disclosure provides a siding panel system comprising:

- a siding panel according to the disclosure; and
- a controller coupled to the light source and configured to send control signals to the light source for generating a lighting configuration.

In another aspect, the disclosure provides a building surface siding system comprising:

- a support structure; and
- at least one siding panel according to the disclosure attached to the support structure.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional lighting on the exterior of a building surface is difficult to install. The present inventors have determined that lighting on the exterior surface of a building that is easy to install would be attractive to home buyers and builders.

Accordingly, one aspect of the disclosure is a siding panel that has a light source. The siding panel includes a panel body having a length extending from a first end to a second end, a width extending from a first edge to a second edge, a front face, and a rear face. The siding panel also includes a first lock extending along the first edge of the panel body and a second lock extending along the second edge of the panel body. A fastening strip is coupled to the first lock. The siding panel also includes a light source extending along the length of the panel body. The light source is secured to the panel body so as to provide light from the front face of the panel body.

Figure 1:
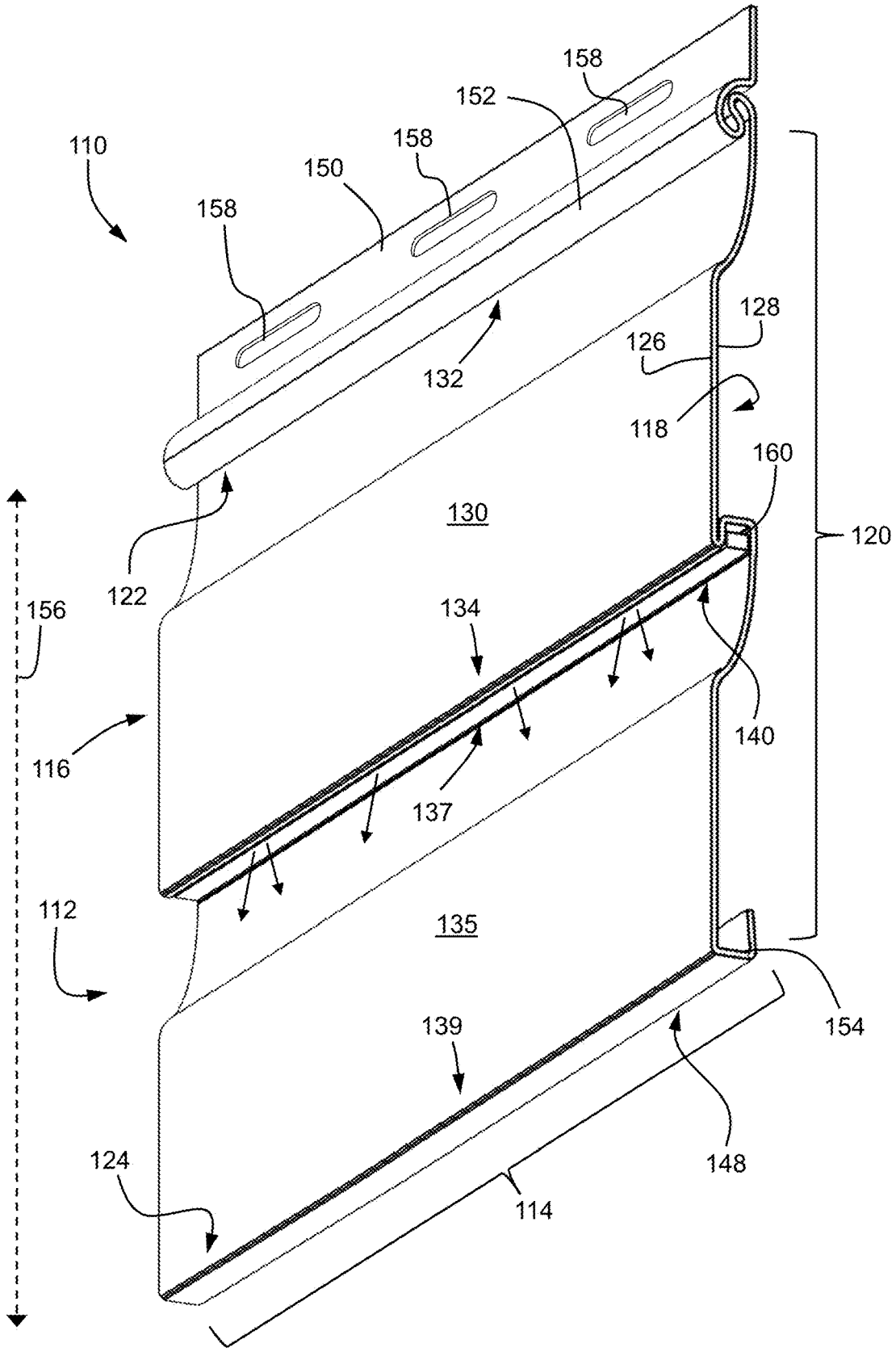
FIG. 1 is a schematic bottom perspective view of a siding panel according to an embodiment of the disclosure.

Such a siding panel is shown in a lower perspective view in FIG. 1. Siding panel 110 includes a panel body 112 having a first end 116, a second end 118, an upper first edge 122 a lower second edge 124, a front face 126, and a rear face 128. The length 114 of panel body 112 extends from first end 116 to second end 118, and the width 120 extends from first edge 122 to second edge 124. Siding panel 110 also includes a first lock 152 extending along the first edge 122 of panel body 112 and a second lock 154 extending along second edge 124 of panel body 112. Siding panel 110 is formed from a thin sheet of material and first lock 152 and second lock 154 are formed from the same sheet of material as panel body 112. Accordingly, first lock 152 is formed by folds in the section of the sheet of material that extends outward from first edge 122. Likewise, second lock 154 is formed by folds in the portion of the sheet of material that extends outward from second edge 124. Siding panel 110 also includes a fastening strip 150 that is coupled to first lock 152 and is formed from the same sheet of material. Siding panel 110 also includes a light source 160 extending along the length 114 of panel body 112. The light source 160 is secured to panel body 112 so as to provide light from the front face 126 of panel body 112.

Panel body 112 is shaped so as to have a siding profile in the form of Dutch lap siding. However, in other embodiments, the panel body has another siding profile, such as clapboard, bead board, shakes, or board and batten, for example.

In certain embodiments of the siding panel as otherwise described herein, the panel body includes a first vertically-extending section and a first overhang. The vertically-extending section has a top edge and a bottom edge, and the first overhang extends rearward from the bottom edge of the first vertically-extending section. Further, the light source is disposed on the first overhang. The term vertical, as used herein, refers to a first direction on the siding panel that runs between the first lock and the second lock. In a typical horizontal installation of siding panels, such a direction would be vertical, and thus the direction between the top edge and bottom edge is referred to herein as vertically-extending. Further, line 156, shown in FIG. 1, illustrates the described first direction. Notwithstanding the foregoing, the siding panels of the disclosure are not limited with respect to the orientation in which they are installed. And thus, the siding panels may be installed in a vertical installation, where the first direction illustrated by line 156 is horizontal.

Furthermore, the vertically-extending section need not be parallel to the first direction. Rather, the direction of extension between the top edge and bottom edge of the vertically-extending section generally extends in the first direction, whereas the first overhang extends in a second direction corresponding to the depth direction of the siding panel. For example, in some embodiments, the vertically-extending section is disposed at an angle of no more than 35 degrees from the first direction, e.g., no more than 25 degrees, e.g., no more than 15 degrees.

Figure 2:
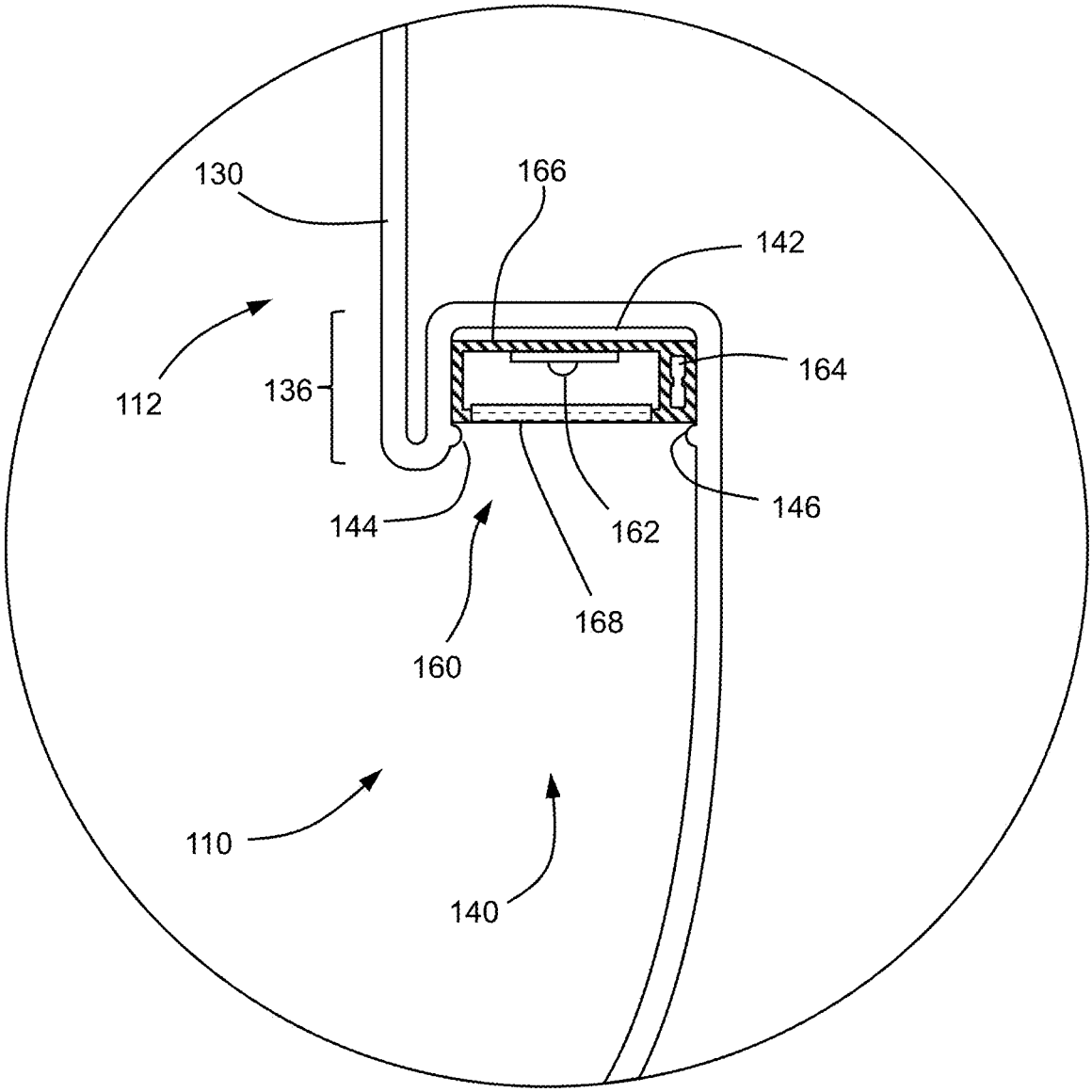
FIG. 2 is a detailed schematic end view of a portion of the siding panel of FIG. 1.

As an example, siding panel 110 includes a first vertically-extending section 130 and a first overhang 140. The first vertically-extending section 130 has a top edge 132 and a bottom edge 134, and first overhang 140 extends rearward from the bottom edge 134 of first vertically-extending section 130. A schematic detailed view of first overhang 140 is shown in FIG. 2.

In certain embodiments of the siding panel as otherwise described herein, the light source is disposed behind the first vertically-extending section. For example, light source 160 is disposed behind a lower end of first vertically-extending section 130 that forms a flange 136 that covers light source 160. Accordingly, flange 136 hides the structure of light source 160 from view. However, the light emitted from light source 160 shines downward and outward so as to viewable from when viewing front face 126.

In certain embodiments of the siding panel as otherwise described herein, the overhang includes a receiving channel disposed behind the first vertically-extending section. Further, the light source is disposed within the receiving channel. For example, as shown in the detailed view of FIG. 2, first overhang 140 of siding panel 110 includes a receiving channel 142 that is positioned behind the flange 136 at the bottom edge 134 of first vertically-extending section 130. Light source 160 is secured within receiving channel 142 to first overhang 140, which provides protection of light source 160 from both impacts and weather.

In another aspect, the disclosure provides a siding panel configured to receive a light source. The siding panel includes a panel body having a length extending from a first end to a second end, a width extending from a first edge to a second edge, a front face, a rear face, a first vertically-extending section having a top edge and a bottom edge, and a first overhang that extends rearward from the bottom edge of the first vertically-extending section. The first overhang includes a receiving channel disposed behind the first vertically-extending section that is configured to receive a light source. The siding panel also includes a first lock extending along the first edge of the panel body, a second lock extending along the second edge of the panel body and a fastening strip coupled to the first lock.

Figure 3:
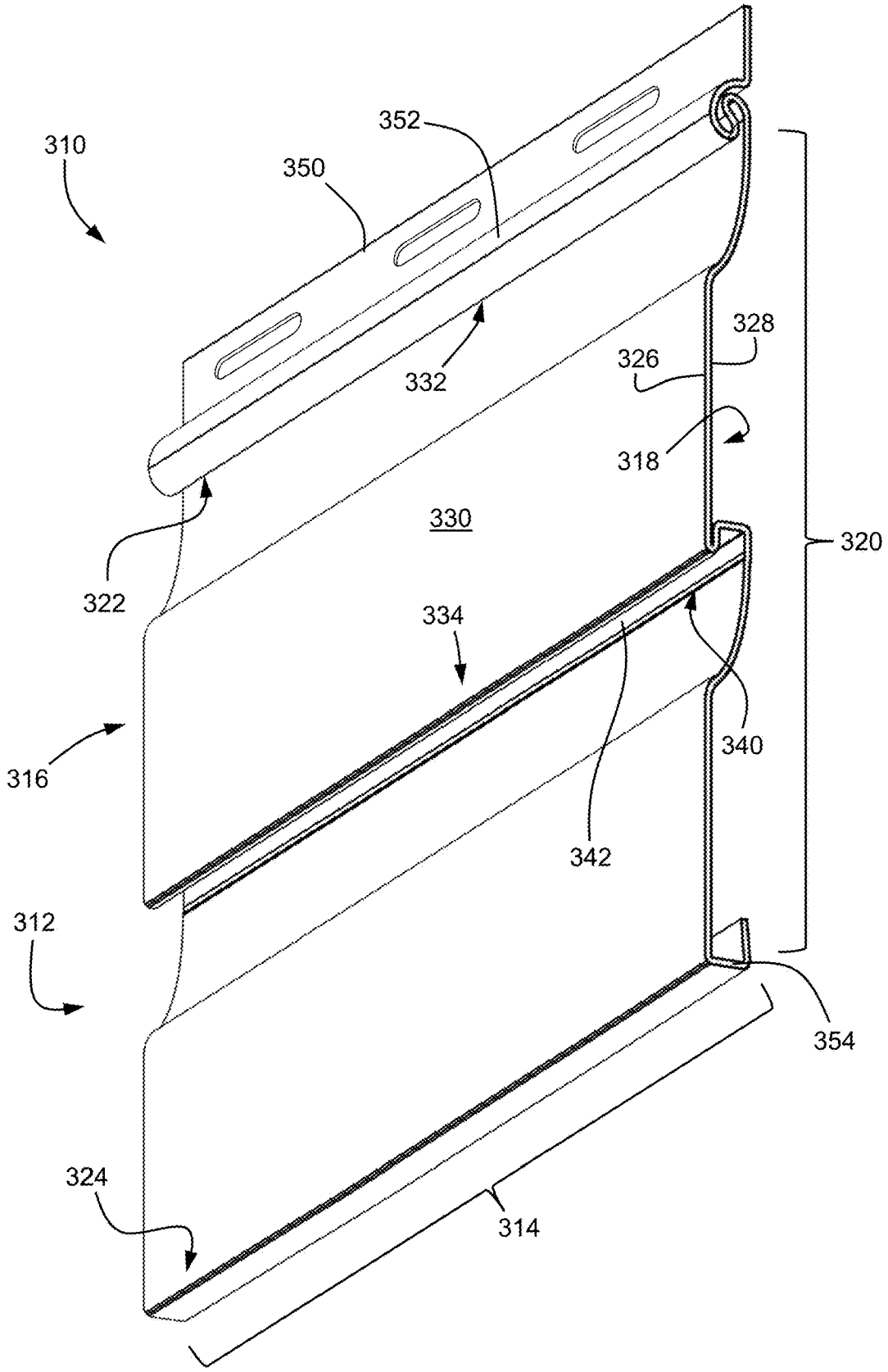
FIG. 3 is a schematic bottom perspective view of a siding panel according to another embodiment of the disclosure.

Such a siding panel is shown in FIG. 3. Siding panel 310 includes a panel body 312 having a length 314 extending from a first end 316 to a second end 318, a width 320 extending from a first edge 322 to a second edge 324, a front face 326 and a rear face 328. Siding panel 310 also includes a first lock 352 extending along the first edge 322 of panel body 112, a second lock 354 extending along second edge 324 of panel body 312, and a fastening strip 350 coupled first lock 352. The panel body 312 of siding panel 310 also includes a first vertically-extending section 330 having a top edge 332 and a bottom edge 334. A first overhang 340 extends rearward from bottom edge 334 of first vertically-extending section 330. Further, first overhang 340 includes a receiving channel 342 disposed behind the first vertically-extending section 330 that is configured to receive a light source. For example, once siding panel 310 is installed on a support structure a builder or the homeowner can install a light source into siding panel 310 by inserting the light source into receiving channel 342 of first overhang 340.

In certain embodiments of the siding panel as otherwise described herein, the receiving channel includes a retaining protrusion configured to secure the light source within the receiving channel. The retaining protrusion forms an obstruction in the opening of the receiving channel, such that any light source that has been inserted into the receiving channel is held securely within the channel. Accordingly, the light source may have a snap-in configuration into the receiving channel. For example, as shown in the detailed view of FIG. 2, siding panel 110 includes a receiving channel 142 with such a protrusion 144. In particular, receiving channel 142 of first overhang 140 includes a first retaining protrusion 144 and a second retaining protrusion 146. First retaining protrusion 144 is positioned at the front of receiving channel 142 behind flange 136 of first vertically-extending section 130. On the other hand, second retaining protrusion 146 is positioned at the rear of receiving channel 142. The first and second retaining protrusions 144, 146 act to secure the light source 160 inside receiving channel 142. In some embodiments, the retaining protrusion is in the form of a ridge that extends along the length of the siding panel. For example, in some embodiments, the retaining protrusion is formed as a part of a fold in a sheet forming operation in shaping the siding panel. In other embodiments, the retaining protrusion is a small bump that extends into the opening of the channel. For example, in some embodiments, the retaining protrusion is formed by pressing the back side of the material sheet that forms the siding panel, such as by using a crimp tool. Further, in some embodiments, a plurality of retaining protrusions are provided along the length of siding panel. Likewise, in some embodiments, as in siding panel 110, a retaining protrusion is included on each of the front side of the receiving channel and the rear side of the receiving channel. In other embodiments, a retaining protrusion is included on only one side of the receiving channel. Still, in some embodiments the receiving channel does not include any retaining protrusions. In such embodiments, the light source may be held in the receiving channel by another attachment method, as described in more detail below.

In certain embodiments of the siding panel as otherwise described herein, the first vertically-extending section is adjacent to the first edge of the panel body. For example, the top edge 132 of first vertically-extending section 130 of siding panel 110 is adjacent to the first edge 122 of panel body 112, which is adjacent to first lock 152. First vertically-extending section 130 is part of a Dutch lap profile and includes a flat portion and a curved portion, where the curved portion extends upward to first edge 122.

In certain embodiments of the siding panel as otherwise described herein, the first overhang is disposed midway between the first edge and second edge of the panel body. For example, first overhang 140 of siding panel 110 is disposed midway between first edge 122 at the top of panel body 112 and second edge 124 at the bottom edge of panel body 112. Panel body 110 has a Dutch lap configuration with two courses that each include a flat portion and a curved portion. First vertically-extending section 130 forms the upper course of the two courses of Dutch lap siding, and first overhang 140 is positioned between the two courses, midway between first edge 122 and second edge 124.

Figure 4:
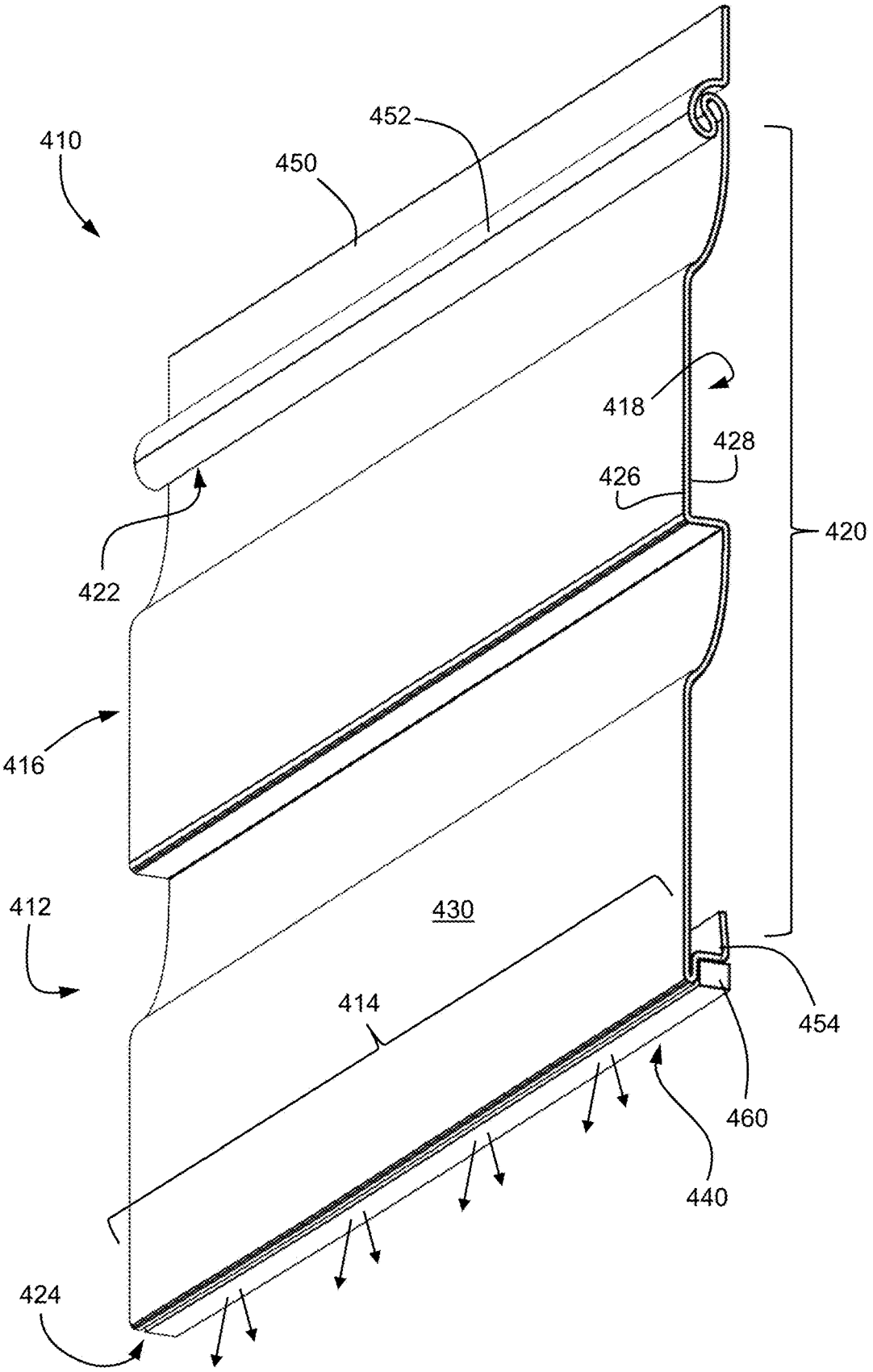
FIG. 4 is a schematic bottom perspective view of a siding panel according to another embodiment of the disclosure.

In certain embodiments of the siding panel as otherwise described herein, the first overhang is adjacent to the second edge of the panel body. For example, in some embodiments, the light source is positioned at the bottom of the panel body and a first overhang that holds the light source is consequently also disposed at the bottom of the panel body adjacent to the second edge. In some embodiments, the siding panel includes only one course, and the first overhang is at the bottom of the course, adjacent to the second edge. In other embodiments, the siding panel includes two or more courses, and the first overhang is adjacent to the lowest course. Such a siding panel is shown in FIG. 4. Siding panel 410 includes a panel body 412 having a first end 416, a second end 418, an upper first edge 422, a lower second edge 424, a front face 426, and a rear face 428. The length 414 of panel body 412 extends from first end 416 to second end 418, and the width 420 extends from first edge 422 to second edge 424. Siding panel 410 also includes a first lock 452 extending along the first edge 422 of panel body 412 and a second lock 454 extending along second edge 424 of panel body 412. Panel body 412 of siding panel 410 includes a first vertically-extending section 430 and a first overhang 440 that are disposed toward the bottom of siding panel 410. Accordingly, first overhang 440 is adjacent second edge 424 of panel body 412.

In some embodiments, the light source is disposed under the second lock. For example, light source 460 in siding panel 410 is disposed under second lock 454 and is secured to a surface at the bottom of second lock 454. In other embodiments, the light source is disposed in front of the second lock. Still, in other embodiments, the light source is positioned in another location with respect the second lock.

In certain embodiments of the siding panel as otherwise described herein, the panel body includes a second vertically-extending section having a top edge and a bottom edge, and a second overhang that extends rearward from the bottom edge of the second vertically-extending section. For example, siding panel 110, shown in FIG. 1, includes a second vertically-extending section 135 that extends from a top edge 137 to a bottom edge 139. A second overhang 148 extends rearward from the bottom edge 139 of second vertically-extending section 135. Second overhang 148 is integrally connected to second lock 154, and second lock 154 is configured to receive a corresponding first lock immediately above second overhang 148.

In certain embodiments of the siding panel as otherwise described herein, the light source includes a plurality of LEDs. In some embodiments, the plurality of LEDs is arranged in a strip that extends along the length of the panel body. For example, light source 160 in siding panel 110 includes a plurality of LEDs 162, as shown in FIG. 2 that are arranged in a strip along the length of panel body 112. The term LED as used herein includes conventional LEDs, organic light emitting diodes (OLEDs) and quantum dot LEDs. In other embodiments, the light source may be in the form of a lamp, such as an incandescent, fluorescent, or halogen bulb. Still, in other embodiments, the light source may be in the form of another lighting element, such as an optical waveguide light pipe, a laser or an optical fiber.

In certain embodiments of the siding panel as otherwise described herein, the light source includes a terminal for receiving electrical current. For example, as shown in FIG. 2, light source 160 includes a terminal 164 in the form of a port for receiving a plug that provides electrical connection to light source 160. In some embodiments, the terminal also provides data communication to the light source, as explained in more detail below.

In certain embodiments of the siding panel as otherwise described herein, the light source is disposed in an elongate housing. Further, in some embodiments, the elongate housing is a weather-proof case. For example, light source 160 includes elongate housing 166 that contains LEDs 162. In some embodiments, the elongate housing is sealed so as to prevent water intrusion. Further, in some embodiments, the elongate housing includes a lens for dispersing or otherwise directing or distributing light from the LEDs or other light emitting element. For example, elongate housing 166 includes a lens 168 that is configured to distribute light from the LEDs 162.

In some embodiments, as described above, the light source is clipped into the siding panel. In other embodiments, the light source is configured to attach to the panel body using adhesive. For example, in some embodiments, one or more surfaces of the lighting housing is covered with an adhesive and the lighting housing is secured to the surface of the panel body. In other embodiments, the light source is configured to attach to the panel body using mechanical fasteners. For example, in some embodiments, the light source includes apertures or tabs for securing the light source to the panel body using screws. Other mechanical fasteners are also possible. Further still, in some embodiments, the housing of the light source is bonded to the surface of the panel body. More permanent connections such as adhesive, mechanical fasteners and bonded attachments provide a siding panel with a light source that is permanently integrated into the siding panel.

In certain embodiments of the siding panel as otherwise described herein, the fastening strip includes apertures configured to receive fasteners for securing the siding panel to a support structure. For example, as shown in FIG. 1, fastening strip 150 of siding panel 110 includes apertures 158 that are configured to receive mechanical fasteners, such as nails or screws, for securing siding panel 110 to a support structure. In some embodiments, the apertures are in the form of slots, which allows the siding panel to move laterally with respect to the fasteners, for example when expanding or contracting. For example, apertures 158 are in the form of slots. In other embodiments, the apertures have another shape. Further, in some embodiments, the fastening strip is formed without apertures. For example, fastening strip 450, in FIG. 4 does not include any apertures. In such an embodiment, the fastening strip may be configured to have fasteners penetrate therethrough, or the fastening strip may be secured to a support structure by another means, such as adhesive.

In certain embodiments of the siding panel as otherwise described herein, the length of the panel body is at least 4 feet, e.g., at least 5 feet, e.g., at least 6 feet. Further, in some embodiments, the length of the panel body is no more than 30 feet, e.g., no more than 24 feet, e.g., no more than 20 feet. For example, in some embodiments, the length of the panel body is in a range from 4 feet to 30 feet, e.g., from 5 feet to 24 feet, e.g., from 6 feet to 20 feet.

In certain embodiments of the siding panel as otherwise described herein, a width of the siding panel is at least 3 inches, e.g., at least 4 inches, e.g., at least 6 inches. Further, in some embodiments, a width of the siding panel is no more than 30 inches, e.g., no more than 24 inches, e.g., no more than 18 inches. For example, in some embodiments, the width of the siding panel is in a range from 3 inches to 30 inches, e.g., from 4 inches to 24 inches, e.g., from 6 inches to 18 inches.

In certain embodiments of the siding panel as otherwise described herein, the panel body has a material thickness in a range from 0.03 inches to 0.20 inches. For example, in some embodiments, the panel body is formed as a thin sheet that is extruded and then formed to include a siding profile. Further, in some embodiments, a single extruded sheet of material is shaped to include the panel body, the locks, and the fastening strip.

Embodiments of the siding panel may be formed from various different materials, and may be constructed in a single piece or in layers of material. In certain embodiments of the siding panel as otherwise described herein, the panel body is formed of one or more of polypropylene, polyethylene, polyvinyl chloride (PVC), acrylonitrile styrene acrylate (ASA), acrylonitrile ethylene styrene (AES), polyurethane, or acrylonitrile butadiene styrene (ABS).

Figure 5:
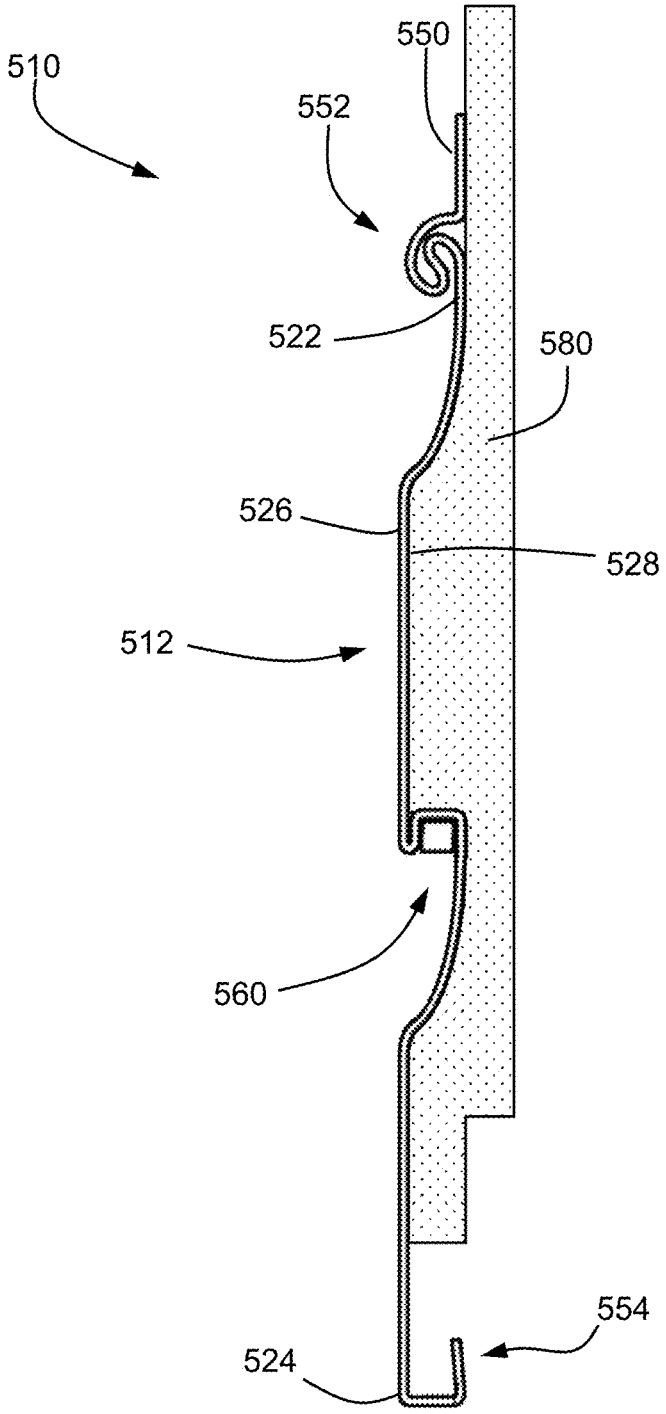
FIG. 5 is a cross-sectional side view of a siding panel according to another embodiment of the disclosure.

In certain embodiments of the siding panel as otherwise described herein, the siding panel further includes insulation disposed on the rear face of the panel body. A cross section of such a siding panel is shown in FIG. 5. Siding panel 510 includes a panel body 512 including a front face 526 and a rear face 528. Siding panel 510 also includes a first lock 552 disposed along a first edge 522 of the panel body 512 and a second lock 554 disposed along a second edge 524 of panel body 512. Second lock 554 is configured to a corresponding first lock of another siding panel. Further, similar to siding panel 110, siding panel 510 also includes a light source 560 secured to front face 526 of panel body 512. Siding panel 510 also includes insulation 580 disposed on the rear face 528 of panel body 512. The insulation 580 reduces the thermal conductivity of siding panel 510 so as to form an insulating panel. As will be understood by those of ordinary skill in the art, the insulation can have various different forms, such as foam insulation. Such insulation can also serve to stiffen the panel structure. As will be apparent to those skilled in the art, a stiffening of the panel can improve the strength of the panel, the impact resistance of the panel, the wind uplift (or resistance) of the panel, and the dimensional stability of the panel. Such improvement in properties, especially dimensional stability can be advantageous to offset any heat gain in the panel from the light source.

In some embodiments of the siding panel as otherwise described herein, the siding panel further includes a heat sink coupled to the light source. For example, in some embodiments, an elongate heat sink is attached to a surface of the light source to dissipate heat generated by lighting elements, such as LEDs, of the light source. In some embodiments, the heat sink includes one or more fins extending away from the light source. In some embodiments, the heat sink is disposed on the front side of the siding panel, for example, below the overhang. In other embodiments, the heat sink extends through the panel body. Various locations and configurations of the heat sink are possible, as will be appreciated by those of ordinary skill in the art.

Figure 6:
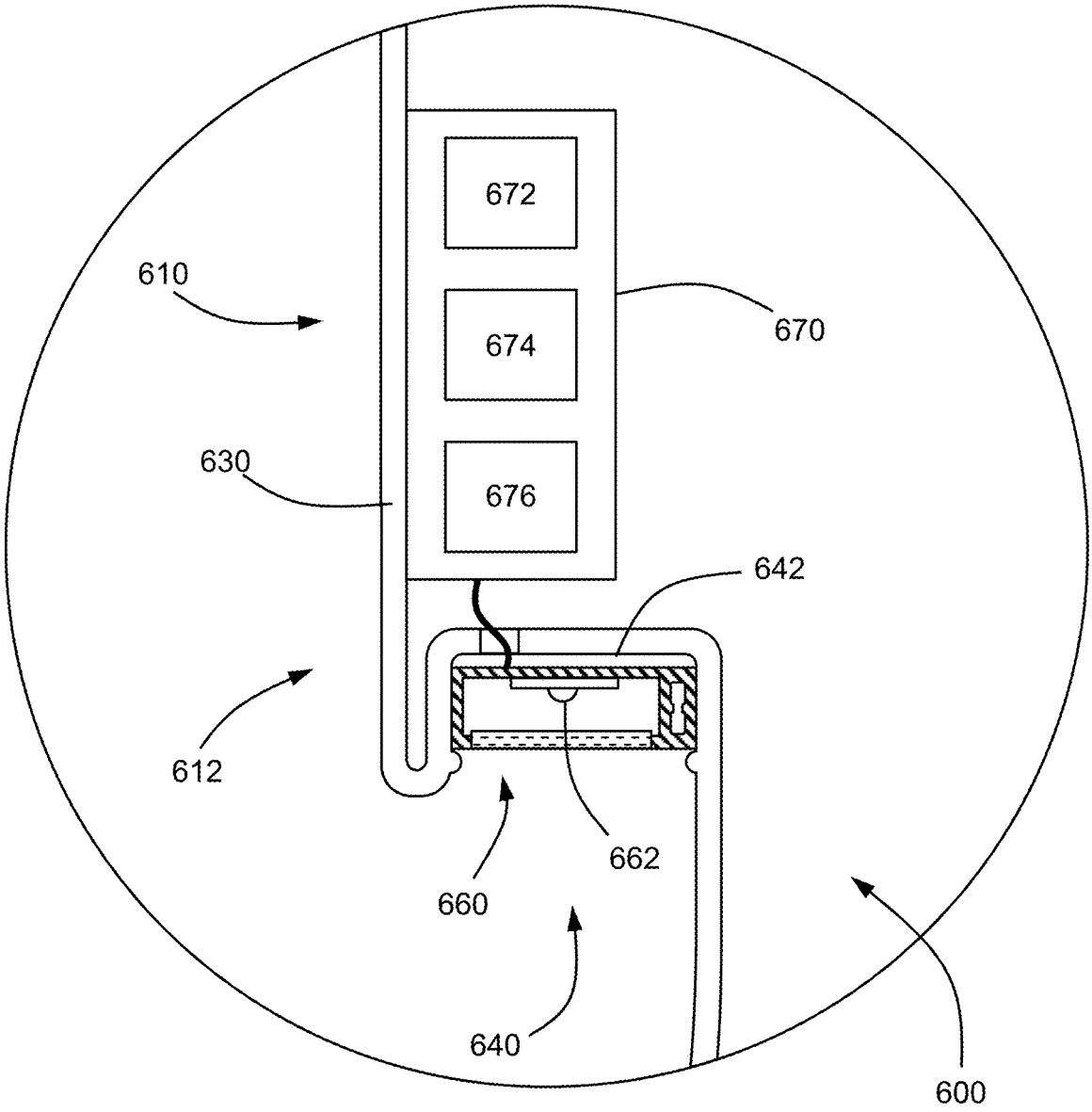
FIG. 6 is a detailed schematic end view of a siding system according to an embodiment of the disclosure.

In another aspect, the disclosure provides a siding panel system that includes a siding panel according to the disclosure that has a light source, and a controller coupled to the light source. The controller is configured to send control signals to the light source for generating a lighting configuration. Such a siding system is shown in FIG. 6. Siding system 600 includes a siding panel 610 that has a similar configuration as siding panel 110, including a panel body 612, a first lock, a second lock, and a fastening strip. Further, panel body 612 includes a first vertically-extending section 630 and a first overhang 640. A light source 660 including LEDS 662 is disposed in a receiving channel 642 within the first overhang 640. Siding system 600 also includes a controller 670 that is coupled to light source 660.

FIG. 6 includes a schematic representation of a controller 670 included on the siding panel 610 that includes a non-transitory computer-readable medium with program instructions stored thereon for performing a method of the disclosure. Controller 670 includes a processor 672, a memory 674, and a network interface 676.

While controller 670 of siding system 600 is disposed directly on panel body 612, in other embodiments, the controller is physically separated from the siding panel. For example, in some embodiments, the controller is part of a smartphone, tablet, notebook computer or home automation hub. Further, while controller 670 is a client device, i.e., a device actively operated by the user, in other embodiments, the controller is a server device, e.g., a device that provides computational services to a client device. Moreover, other types of computational platforms are also possible in embodiments of the disclosure, such as an application-specific integrated circuit (ASIC) that performs processor operations, a digital signal processor (DSP), a network processor, or a field-programmable gate array (FPGA).

Processor 672 of controller 670 includes a computer processing elements, e.g., a central processing unit (CPU), an integrated circuit that performs processor operations, a digital signal processor (DSP), or a network processor. In some embodiments, the processor includes register memory that temporarily stores instructions being executed and corresponding data, as well as cache memory that temporarily stores performed instructions. Memory 674 is a computer-usable memory, e.g., random access memory (RAM), read-only memory (ROM), or non-volatile memory such as flash memory, solid state drives, or hard-disk drives. In certain embodiments, memory 674 stores program instructions that are executable by processor 672 for carrying out the methods and operations of the disclosure. Network interface 676 provides digital communication between controller 670 and other computing systems or devices. In some embodiments, the network interface operates via a physical wired connection, such as an ethernet connection. In other embodiments, the network interface communicates via a wireless connection, e.g., IEEE 802.11 (Wifi) or BLUETOOTH. Other communication conventions are also possible.

In some embodiments, the siding system includes additional siding panels. Further, in some embodiments, the siding system includes a single controller that sends control signals to the light source of each siding panel. In other embodiments, each of the siding panels in the siding system includes a separate controller. Thus, in some embodiments, the activation and deactivation of the light source of each siding panel is independent from those of the other siding panels of the siding system. On the other hand, in some embodiments, the controller is formed by a network of control units, each of which is provided on one siding panel of the siding system. Thus, in some embodiments, the control units are operable to for the controller so as to control the respective light sources in a coordinated fashion. Further, in some embodiments, the control units are operable to control the respective light sources independently.

In some embodiments, the controller includes programmed instructions stored in memory for activating and deactivating the light source at predetermined times. For example, in some embodiments, the controller is operable to turn on the light source in the evening and turn the light source off in the morning. Further, in some embodiments, the controller is configured to receive a signal from an ambient light sensor. For example, in some embodiments, the controller includes programmed instructions stored in memory for activating the light source when a signal from an ambient light sensor indicates that the ambient light is low (e.g., at night), and for deactivating the light source when the signal from the ambient light sensor indicates that the ambient light is high (e.g., during the day).

In certain embodiments of the siding system as otherwise described herein, the lighting configuration includes a selected color. For example, in some embodiments the light source has a variable color profile. For example, in some embodiments, the light source includes LEDs of various colors, which allows the light source to emit light in a range of colors depending on the intensity of light emitted by LEDs of each color. Thus, in some embodiments, the controller includes programmed instructions stored in memory for sending a control signal to the light source so as to emit light of a preselected color. For example, the controller may receive input from a user through the network interface that directs the controller to operate the light source of the siding panel with a certain color. The controller then sends a control signal to the light source to emit a particular light by tuning the various LEDs of the light source. Thus, for example, a user may select a particular color of lighting based on a holiday, such as orange in October or pink on Valentine's Day. Accordingly, in some embodiments, the siding panels of the disclosure provide decorative lighting on the exterior of the building surface. Moreover, in some embodiments, the controller is configured to operate different siding panels of the siding system with different colors.

In certain embodiments of the siding system as otherwise described herein, the lighting configuration includes a lighting sequence. For example, in some embodiments, the controller includes programmed instructions stored in memory for sending a control signal to the light source so as to flash the light source on and off. Further, in some embodiments, the light source includes a strip of lighting elements and the controller is configured to send a control signal to the light source to operate the lighting elements in a sequence. For example, the lighting elements may be controlled to illuminate sequential so as to appear as though the light moves along the siding panel. Various other lighting configurations and patterns are also possible, either within a single siding panel, or in a coordinated fashion amongst several siding panels.

Figure 7:
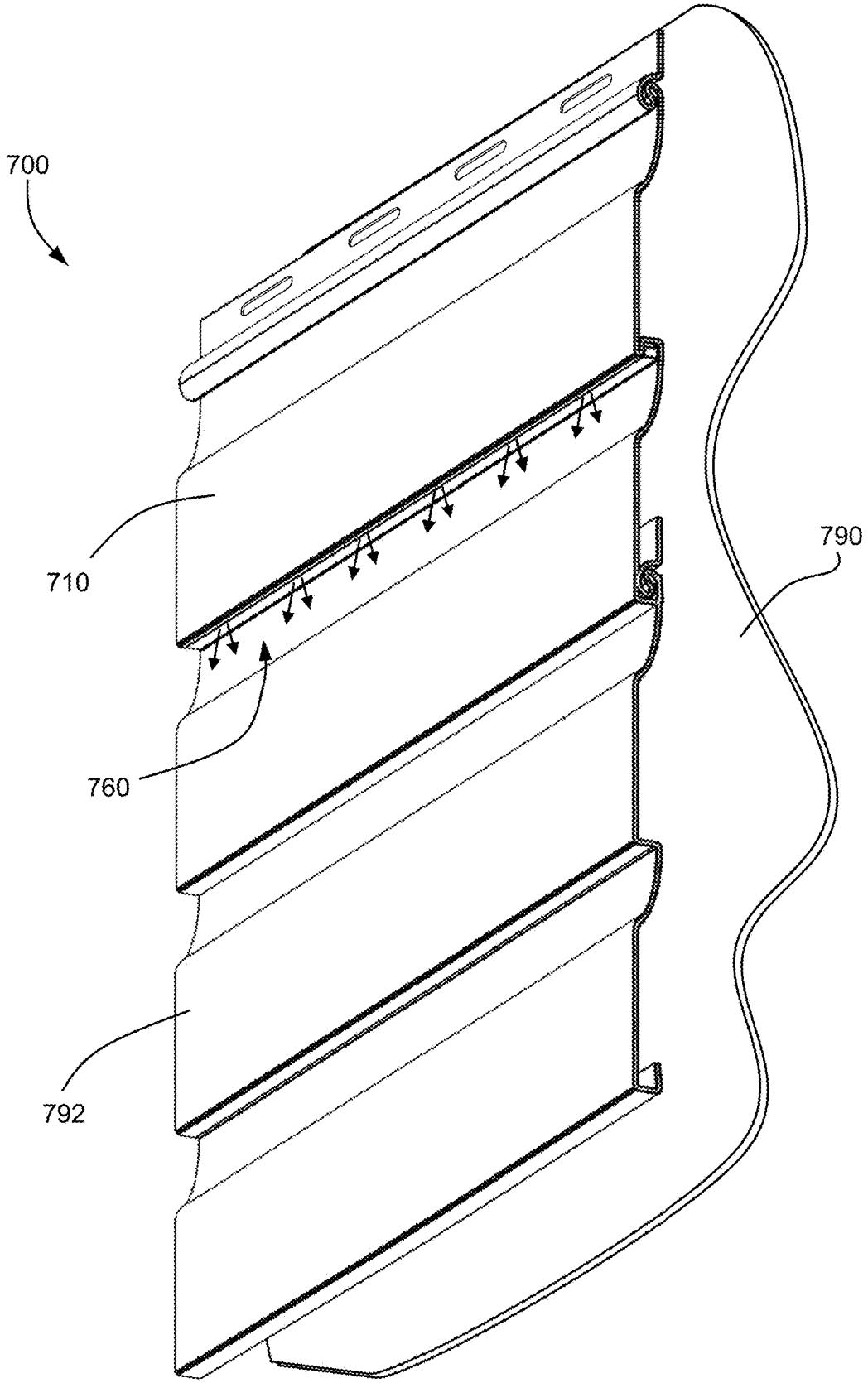
FIG. 7 is a schematic bottom perspective view of a building surface siding system according to an embodiment of the disclosure.

In another aspect, the disclosure provides a building surface siding system including a support structure and at least one siding panel of the disclosure attached to the support structure. For example, in some embodiments, the support structure is part of an exterior wall, such as an exterior building substrate or exterior sheathing. Such a building surface siding system is shown in FIG. 7. Building surface siding system 700 includes a first siding panel 710 according to the disclosure that has a light source 760. First siding panel 710 is attached to support structure 790.

In some embodiments, the building surface siding system includes several siding panels including light sources that are attached to the support structure. For example, a lock of a second siding panel may be coupled to a lock of a first siding panel, where each siding panel includes a light source. Accordingly, the siding panels may form two rows of panels that both emit light from respective light sources. Further, in some embodiments, the entire support structure is covered by siding panels according to the disclosure, each having a respective light source.

In other embodiments, the building surface siding system includes a second siding panel without a light source attached to the support structure, where the second siding panel is coupled to a first siding panel of the at least one siding panel. For example, building surface siding system 700 includes a second siding panel 792 that is also secured to support structure 790. Furthermore, an upper lock of second siding panel 792 is coupled to a lower lock of first siding panel 710 so as to form a continuous wall covering over support structure 790.

Various aspects and embodiments of the disclosure are provided by the enumerated embodiments provided below, which may be combined in any number and in any combination that is not technically or logically inconsistent.

Embodiment 1. A siding panel including a light source, the siding panel comprising:

a panel body having a length extending from a first end to a second end, a width extending from a first edge to a second edge, a front face, and a rear face;

a first lock extending along the first edge of the panel body;

a second lock extending along the second edge of the panel body;

a fastening strip coupled to the first lock; and a light source extending along the length of the panel body and secured to the panel body so as to provide light from the front face of the panel body.

Embodiment 2. The siding panel according to embodiment 1, wherein the panel body includes:

a first vertically-extending section having a top edge and a bottom edge, and a first overhang that extends rearward from the bottom edge of the first vertically-extending section, and wherein the light source is disposed on the first overhang.

Embodiment 3. The siding panel according to embodiment 2, wherein the light source is disposed behind the first vertically-extending section.

Embodiment 4. The siding panel according to embodiment 2 or embodiment 3, wherein the overhang includes a receiving channel disposed behind the first vertically-extending section, and wherein the light source is disposed within the receiving channel.

Embodiment 5. A siding panel configured to receive a light source, the siding panel comprising:

a panel body including:

a length extending from a first end to a second end, a width extending from a first edge to a second edge, a front face, a rear face, a first vertically-extending section having a top edge and a bottom edge, a first overhang that extends rearward from the bottom edge of the first vertically-extending section, the first overhang including a receiving channel disposed behind the first vertically-extending section that is configured to receive a light source;

a first lock extending along the first edge of the panel body;

a second lock extending along the second edge of the panel body; and a fastening strip coupled to the first lock.

Embodiment 6. The siding panel according to embodiment 4 or embodiment 5, wherein the receiving channel includes a retaining protrusion configured to secure the light source within the receiving channel.

Embodiment 7. The siding panel according to any of embodiments 2 to 6, wherein the first vertically-extending section is adjacent to the first edge of the panel body.

Embodiment 8. The siding panel according to embodiment 7, wherein the first overhang is disposed midway between the first edge and second edge of the panel body.

Embodiment 9. The siding panel according to any of embodiments 2 to 7, wherein the first overhang is adjacent to the second edge of the panel body.

Embodiment 10. The siding panel according to any of embodiments 2 to 8, wherein the panel body includes:

a second vertically-extending section having a top edge and a bottom edge, and a second overhang that extends rearward from the bottom edge of the second vertically-extending section.

Embodiment 11. The siding panel according to any of embodiments 1 to 10, wherein the light source includes a plurality of LEDs.

Embodiment 12. The siding panel according to embodiment 11, wherein the plurality of LEDs is arranged in a strip that extends along the length of the panel body.

Embodiment 13. The siding panel according to any of embodiments 1 to 12, wherein the light source includes a terminal for receiving current.

Embodiment 14. The siding panel according to any of embodiments 1 to 13, wherein the light source is disposed in an elongate housing.

Embodiment 15. The siding panel according to embodiment 14, wherein the elongate housing is a weather-proof case.

Embodiment 16. The siding panel according to any of embodiments 1 to 15, wherein the light source is configured to attach to the panel body using adhesive.

Embodiment 17. The siding panel according to any of embodiments 1 to 15, wherein the light source is configured to attach to the panel body using mechanical fasteners.

Embodiment 18. The siding panel according to any of embodiments 1 to 17, wherein the length of the panel body is at least 4 feet, e.g., at least 5 feet, e.g., at least 6 feet.

Embodiment 19. The siding panel according to any of embodiments 1 to 18, wherein the length of the panel body is no more than 30 feet, e.g., no more than 24 feet, e.g., no more than 20 feet.

Embodiment 20. The siding panel according to any of embodiments 1 to 19, wherein a width of the siding panel is at least 3 inches, e.g., at least 4 inches, e.g., at least 6 inches.

Embodiment 21. The siding panel according to any of embodiments 1 to 20, wherein a width of the siding panel is no more than 30 inches, e.g., no more than 24 inches, e.g., no more than 18 inches.

Embodiment 22. The siding panel according to any of embodiments 1 to 21, wherein a thickness of the panel body is in a range 0.03 inches to 0.2 inches.

Embodiment 23. The siding panel according to any of embodiments 1 to 22, wherein the panel body includes one or more of polypropylene, polyethylene, polyvinyl chloride (PVC), acrylonitrile styrene acrylate (ASA), acrylonitrile ethylene styrene (AES), polyurethane, or acrylonitrile butadiene styrene (ABS).

Embodiment 24. The siding panel according to any of embodiments 1 to 23, further comprising insulation disposed on the rear face of the panel body.

Embodiment 25. A siding panel system comprising:

a siding panel according to any of embodiments 1 to 24; and a controller coupled to the light source and configured to send control signals to the light source for generating a lighting configuration.

Embodiment 26. The siding panel system according to embodiment 25, wherein the lighting configuration includes a selected color.

Embodiment 27. The siding panel system according to embodiment 26, wherein the lighting configuration includes a lighting sequence.

Embodiment 28. The siding panel system according to any of embodiments 25 to 27, further comprising at least one additional siding panel according to any of embodiments 1 to 24 configured to receive control signals from the controller.

Embodiment 29. A building surface siding system comprising:

a support structure; and at least one siding panel according to any of embodiments 1 to 24 attached to the support structure.

Embodiment 30. The building surface system according to embodiment 29, further comprising a second siding panel without a light source attached to the support structure, wherein the second siding panel is coupled to a first siding panel of the at least one siding panel.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A building cladding including a light source configured to be installed on a surface of a building, the building cladding comprising:

a cladding body having a length extending from a first end to a second end, a width extending from a first edge to a second edge, a front face configured to face away from the building, and an opposing rear face, the cladding body including:

a first section extending in a direction generally parallel to the surface of the building, the first section having a first edge and a second edge, and a first overhang that extends rearward from the second edge of the first section;

a light source extending along the length of the cladding body and secured to the cladding body so as to provide light from the front face of the cladding body, wherein the light source is disposed on the first overhang, wherein the overhang includes a receiving channel disposed behind the first vertically-extending section, and wherein the light source is disposed within the receiving channel behind the first vertically-extending section.

2. The building cladding according to claim 1, wherein the light source includes a plurality of LEDs.

3. The building cladding according to claim 1, wherein the light source is disposed in an elongate housing, which is disposed in the receiving channel.

4. The building cladding according to claim 1, wherein the elongate housing includes a lens configured to distribute light from the light source.

5. The building cladding according to claim 1, wherein the receiving channel includes a retaining protrusion configured to secure the light source within the receiving channel.

6. The building cladding according to claim 1, wherein the first vertically-extending section includes a flange behind which the light source is disposed.

7. The building cladding according to claim 6, wherein the flange defines a wall of the receiving channel.

8. The building cladding according to claim 1, wherein the cladding body has a material thickness in a range from 0.03 inches to 0.20 inches.

9. The building cladding according to claim 1, wherein the cladding body is formed as a thin sheet that is extruded and then formed with a profile of the building cladding.

10. The building cladding according to claim 1, wherein the cladding body is formed of one or more of polypropylene, polyethylene, polyvinyl chloride (PVC), acrylonitrile styrene acrylate (ASA), acrylonitrile ethylene styrene (AES), polyurethane, or acrylonitrile butadiene styrene (ABS).

11. The building cladding according to claim 1, further comprising insulation disposed on the rear face of the cladding body.

12. The building cladding according to claim 1, in the form of a siding panel.

13. The building cladding according to claim 1, wherein the first edge of the first section is configured as a top edge and the second edge of the first section is configured as a bottom edge.

14. The building cladding according to claim 1, wherein the overhang is configured to face parallel to the building surface.

15. The building cladding according to claim 1, wherein the overhang is configured to face down.

16. A building cladding system comprising:

a building cladding according to claim 1; and a controller coupled to the light source and configured to send control signals to the light source for generating a lighting configuration.

17. The building cladding system according to claim 16, wherein the lighting configuration includes a selected color.

18. The building cladding system according to claim 16, wherein the lighting configuration includes a lighting sequence.

19. A building surface cladding system comprising:

a building have a surface; and at least one building cladding according to claim 1 attached to the surface of the building.

20. The building cladding according to claim 1, further comprising a heat sink coupled to the light source, the heat sink includes one or more fins extending away from the light source.

* * * * *